US005746505A

United States Patent [19]

Hirobe et al.

[11] Patent Number: 5,746,505

[45] Date of Patent: May 5, 1998

[54] ELECTRICAL CONDUCTOR FOR AN OPTICAL SYSTEM

[75] Inventors: Junichi Hirobe; Yukihiro Aikawa; Ikuo Makie; Tsutomu Sugaya; Hiroyuki Sadamori, all of Osaka, Japan

[73] Assignee: Mita Industrial Co., Ltd., Osaka, Japan

[21] Appl. No.: 602,689

[22] Filed: Feb. 16, 1996

Related U.S. Application Data

[63] Continuation of Ser. No. 305,314, Sep. 15, 1994, abandoned.

[30] Foreign Application Priority Data

Sep. 21, 1993 [JP] Japan ..... 5-234814

[51] Int. Cl.[6] ..... F21V 7/22

[52] U.S. Cl. ..... 362/260; 362/263; 362/67; 313/607

[58] Field of Search ..... 362/260, 263, 362/217, 255, 256; 355/67, 69; 313/607, 635

[56] References Cited

U.S. PATENT DOCUMENTS

| | | | |
|---|---|---|---|
| 2,327,346 | 8/1943 | Furedy | 362/263 X |
| 3,868,182 | 2/1975 | Kidd | 355/67 |
| 4,233,653 | 11/1980 | Jongerius et al. | 362/263 X |
| 4,569,004 | 2/1986 | Peterson | 362/263 |
| 4,767,193 | 8/1988 | Ota et al. | 362/217 X |
| 5,224,770 | 7/1993 | Simmons et al. | 362/260 X |
| 5,391,960 | 2/1995 | Moribayoshi | 313/607 X |

*Primary Examiner*—Thomas M. Sember

*Attorney, Agent, or Firm*—Beveridge, DeGrandi, Weilacher & Young, LLP

[57] ABSTRACT

The present invention provides an electrical conductor for an optical system (M13) adapted to be stuck to a unit body (M11) for supporting a fluorescent lamp (M12). The electrical conductor (M13) includes: a base portion (M131) which is disposed in proximity to an outer peripheral surface of a glass tube (M121) of the fluorescent lamp (M12) such that mercury in the glass tube (M121) is diffusible, and which is opposite to the glass tube (M121) throughout the length thereof; and reflection portions (M132, M133) integrally formed with the base portion (M131).

8 Claims, 3 Drawing Sheets

ELECTRICAL CONDUCTOR FOR AN OPTICAL SYSTEM

This application is a continuation of application Ser. No. 08/305,314, filed Sep. 15, 1994, now abandoned which application is entirely incorporated herein by reference.

TECHNICAL FIELD OF THE INVENTION

The present invention relates to an electrical conductor for an optical system, and more particularly to an electrical conductor for an optical system most suitable for an image forming apparatus using a rod-like fluorescent lamp for illuminating and scanning a document.

RELATED BACKGROUND ART

Generally, an image forming apparatus such as a copying machine or the like comprises an optical system for illuminating and scanning a document to form an optical image; and an image forming unit which forms an electrostatic latent image based on the optical image thus formed and which develops the electrostatic latent image to a toner image, which is then transferred to paper.

The optical system includes a fluorescent lamp for illuminating and scanning a document. The fluorescent lamp has a glass tube having an inner wall to which a fluorescent substance is applied; rare gas and mercury sealed in the glass tube; and electrodes disposed at the ends of the glass tube. The fluorescent lamp is arranged such that a voltage is applied across the electrodes to generate ultraviolet rays, and that the fluorescent substance absorbs the ultraviolet rays thus generated, thereby to emit fluorescence.

The fluorescent lamp is liable to be bright at the center portion thereof and to be dark at each of the both end portions thereof. Accordingly, to supplement the light at each of the end portions, a pair of side reflectors which are opposite to each other, are disposed at the unit body of the optical system, and the fluorescent lamp is disposed at the center part in the direction in which the side reflectors are opposite. As to the side reflectors, the front and both end surfaces are of the surface reflective type and no consideration is taken for the material thereof.

On the other hand, when used for an image forming apparatus, the fluorescent lamp is required to have instantaneous lightening characteristics. Accordingly, the mercury inside of the glass tube is preferably distributed in the glass tube as uniformly as possible. In this connection, an electrically conductive tape serving as a mercury diffuser has conventionally been stuck throughout the length of the glass tube of a fluorescent lamp.

According to the conventional arrangement above-mentioned, an electrically conductive tape is stuck to the glass tube of a fluorescent lamp. This increases the cost of the fluorescent lamp, resulting in an increase in the production cost of the image forming apparatus. More specifically, sticking a conductive tape throughout the length of a cylindrical glass tube, is difficult and therefore poor in workability, thus disadvantageously lowering the yield.

The electrically conductive tape is made of a metallic material. Metal surface is relatively high in reflectance. Accordingly, the electrically conductive tape is also to serve as reflectors.

In the arrangement where the electrically conductive tape is stuck to the fluorescent lamp as above mentioned, however, the adhesives of the tape surface are interposed between the metallic material portion and the light source. This disadvantageously lowers the reflectance.

Further, since the electrically conductive tape is stuck along the cylindrical surface of the fluorescent lamp, light reflected from the tape is reflected toward the light source of the fluorescent lamp. As a result, it is difficult to cause the light to be reflected to the surface of a document.

Thus, the conventional electrically conductive tape has not sufficiently served as reflectors.

Further, since the side reflectors are members forming a pair, it is difficult to properly position such members when assembled with the unit body of the fluorescent lamp.

DISCLOSURE OF THE INVENTION

For the foregoing reasons, there is a need for an electrical conductor for an optical system which enables the lamp to be instantaneously lighted without an electrically conductive tape stuck thereto and which is readily attached.

The present invention is directed to an electrical conductor for an optical system that satisfies this need. The inventor has accomplished the present invention with attention given to the fact that a proximity electrical conductor, even separated from mercury, can sufficiently serve as a mercury diffuser if the distance between the electrical conductor and the mercury is within a predetermined value (for example, 10 mm as shown in the following embodiment).

As one aspect, the present invention provides an electrical conductor for an optical system adapted to be stuck to a unit body for supporting a fluorescent lamp, comprising a base portion which is disposed in proximity to an outer peripheral surface of a glass tube of a fluorescent lamp such that mercury in the glass tube is diffusible, and which is opposite to the glass tube throughout the length thereof. According to the arrangement above-mentioned, the base portion forms a mercury diffuser for diffusing mercury in the fluorescent lamp substantially uniformly throughout the length of the glass tube. The base portion is adapted to be stuck to the unit body. This eliminates the necessity to stick an electrically conductive tape to the glass tube of a fluorescent lamp. This advantageously improves the workability and increases the yield.

According to the present invention, a preferred embodiment is arranged such that a pair of reflection portions are provided at the both ends of the base portion for reflecting light coming from the both end portions of the glass tube to a surface of a document. In this embodiment, the reflection portions form side reflectors for reflecting light coming from the both end portions of the glass tube to the surface of a document. The base portion and the reflection portions are made in a unitary structure. Accordingly, by attaching a single conductor member to a predetermined position, the side reflectors and the mercury diffuser can simultaneously be attached. This not only reduces the number of attaching steps, but also improves the fluorescent lamp in lightening performance without an electrically conductive tape stuck thereto. The elimination of the electrically conductive tape lowers the cost of the fluorescent lamp, resulting in a decrease in the production cost of the image forming apparatus.

Further, a pair of reflection portions forming the side reflectors are integrally formed through the base portion forming the mercury diffuser. This facilitates positioning of the reflection portions when assembled with the unit body of the fluorescent lamp. This advantageously improves the workability.

According to another preferred embodiment of the present invention, the base portion and the reflection portions are formed in a unitary structure and made of a tape member of luster aluminium. This improves the reflectance of light from the fluorescent lamp.

According to a further preferred embodiment of the present invention, the tape member is stuck onto a flat inner bottom surface of the unit body. This further improves the tape adhesion workability.

According to still another preferred embodiment of the present invention, the base portion has a widthwise center portion that confronts the glass tube with respect to a diametrical direction of the glass tube along a perpendicular line. This further improves mercury diffusion.

According to a still further preferred embodiment of the present invention, the unit body is formed by a resin molded article which mechanically supports the fluorescent lamp and which so surrounds the fluorescent lamp as to prevent the irregular reflection of light from the fluorescent lamp. This further increases the difference in light and darkness between the unit body and the reflection portions. This advantageously provides more effective reflection.

Thus, according to the present invention, the electrical conductor for an optical system enables the fluorescent lamp to be instantaneously lighted without an electrically conductive tape stuck thereto, and the electrical conductor itself can readily be attached.

BRIEF DESCRIPTION OF THE DRAWINGS

By way of example, only specific embodiments of the present invention will now be described with reference to the accompanying drawings, in which.

DESCRIPTION OF THE PREFERRED EMBODIMENTS

The following description will discuss preferred embodiments of the present invention with reference to the attached drawings.

Figure 1:
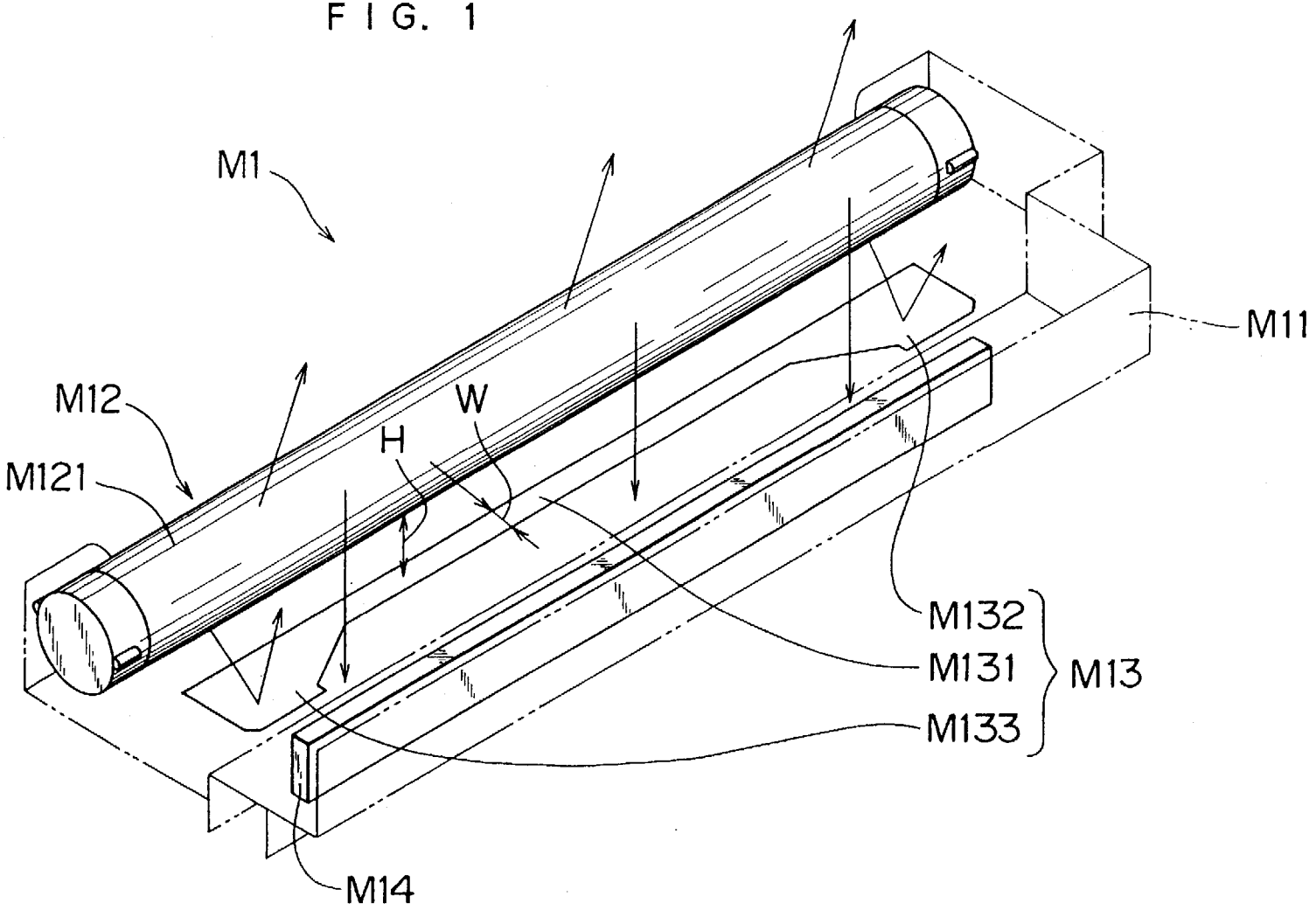
FIG. 1 is a schematic perspective view illustrating main portions of an electrical conductor for an optical system according to an embodiment of the present invention.
Figure 2:
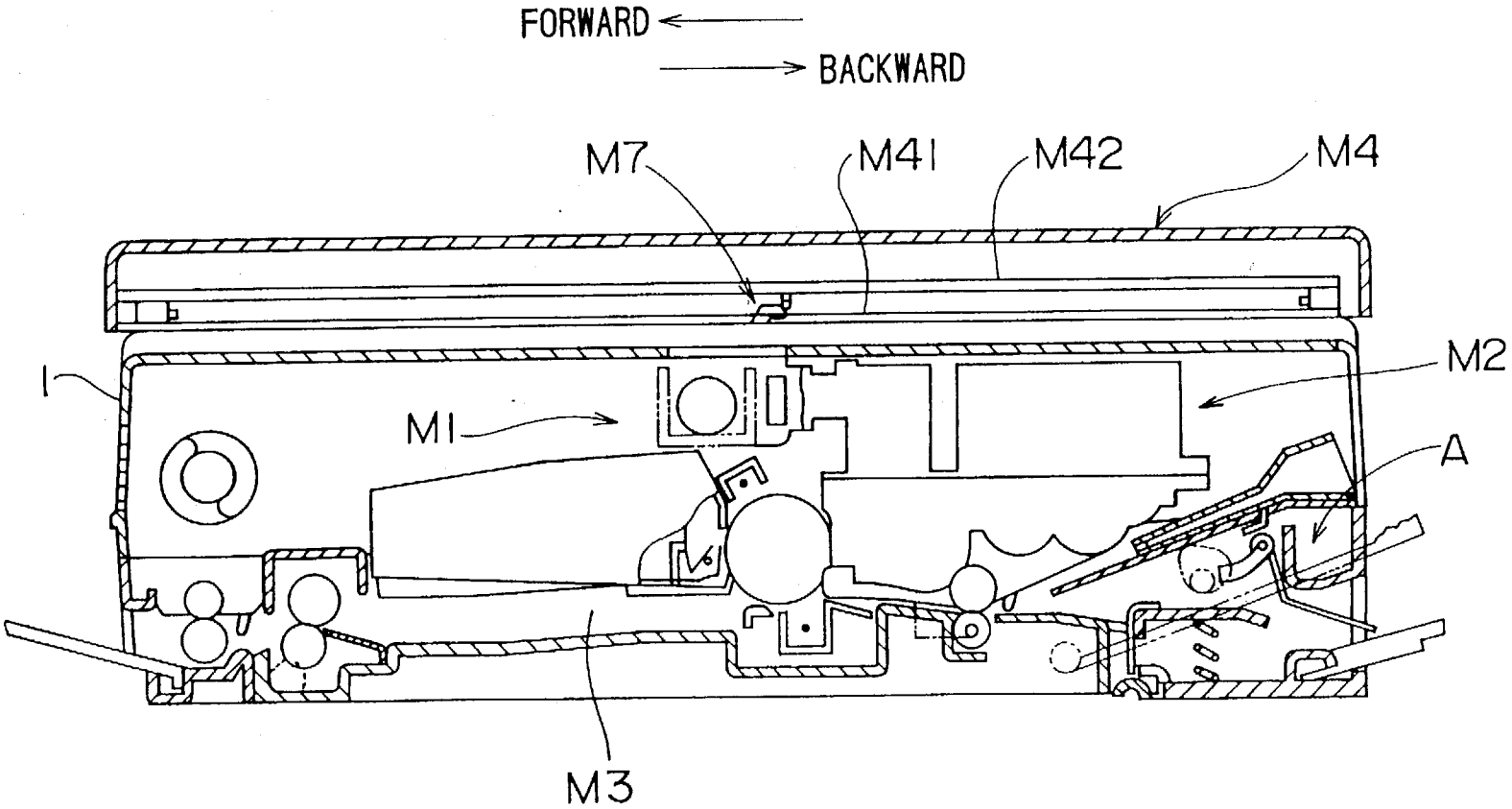
FIG. 2 is a schematic section view illustrating main portions of the optical system of a copying machine, as an image forming apparatus, using the electrical conductor for an optical system shown in FIG. 1.
Figure 3:
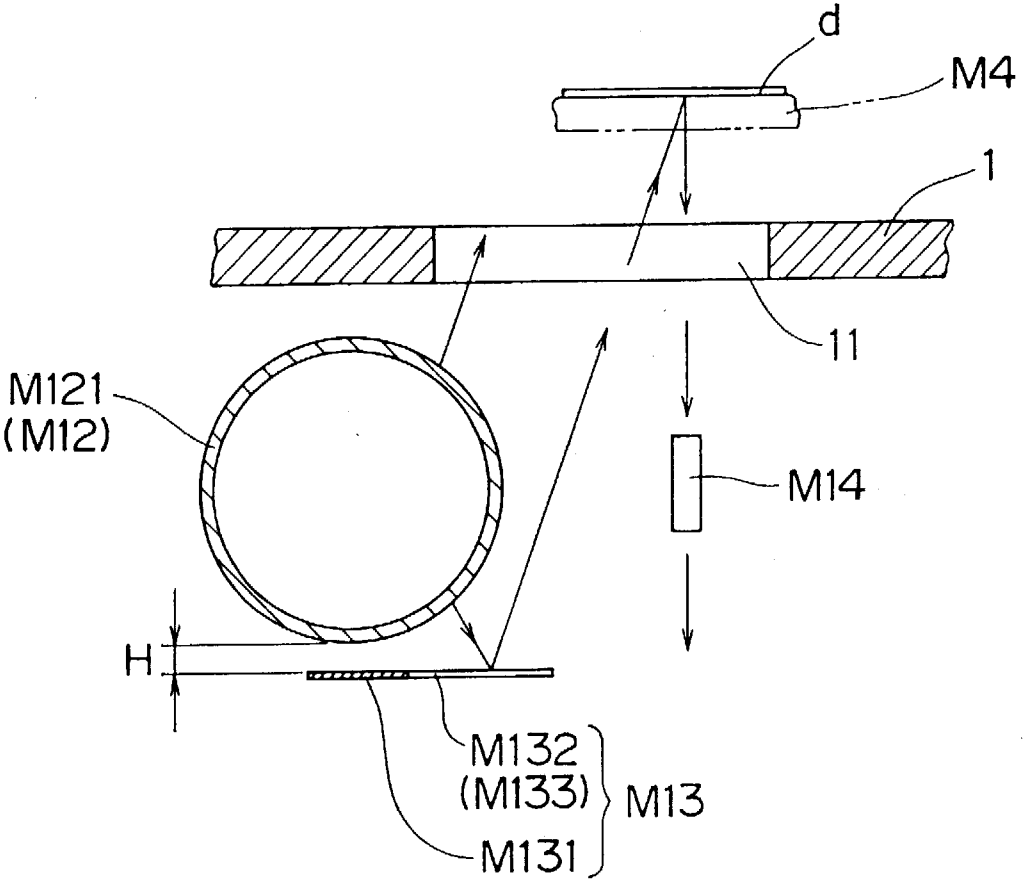
FIG. 3 is a schematic enlarged section view of main portions of the optical system in FIG. 2.

FIG. 1 is a schematic perspective view illustrating main portions of an electrical conductor for an optical system according to an embodiment of the present invention. FIG. 2 is a schematic section view illustrating main portions of the optical system of a copying machine, as an image forming apparatus, using the electrical conductor for an optical system shown in FIG. 1. FIG. 3 is a schematic enlarged section view of main portions of the optical system in FIG. 2.

Referring to FIG. 2, the copying machine in this embodiment has a machine body 1 incorporating an optical system M1 and an image forming unit M2 both serving as main portions of image forming means. The machine body 1 also incorporates a paper delivery passage M3 for feeding paper to the image forming unit M2. A paper feed mechanism A is disposed upstream of the paper delivery passage M3.

The machine body 1 is provided on the top thereof with a document stand M4. The document stand M4 has a document placing plate M41 made of glass on which a document is to be placed, and a document holder M42 for shielding external light. The document stand M4 is movable, on the top surface of the machine body 1, back (rightward in FIG. 2) and forth (leftward in FIG. 2). The document stand M4 is adapted to be positionally detected by position detecting means M7.

Referring to FIG. 1, the optical system M1 has a unit body M11 in which a fluorescent lamp M12 is removably housed. In this embodiment, the unit body M11 has a plurality of functions. Firstly, the unit body M11 serves as a supporting member for mechanically supporting the fluorescent lamp M12 of the optical system M1. Secondly, the unit body M11 serves as a hood for preventing the irregular reflection of light from the fluorescent lamp M12 supported. To achieve these functions, this embodiment employs the unit body M11 made of a resin molded article of ABS finished in black color.

The fluorescent lamp M12 is connectable to a power source through a terminal (not shown) and is arranged such that a predetermined voltage is applied thereto when a copy button (not shown) of the copying machine is connected.

Disposed immediately below and opposite to the fluorescent lamp M12 is a tape member M13 which serves as an electrical conductor for an optical system and which is stuck to the inner bottom surface of the unit body M11. The inner bottom surface is flat such that the tape member M13 can be readily stuck thereto. The tape member M13 is made of luster aluminium and has a base portion M131 and a pair of reflection portions M132, M133 in a unitary structure.

The base portion M131 is made in the form of a band having a width of about 5 mm. The base portion M131 is opposite to a glass tube M121 of the fluorescent lamp M12 throughout the length thereof and is disposed in proximity to the outer peripheral surface of the glass tube M121 such that mercury in the glass tube M121 is diffusible. The base portion M131 forms a mercury diffuser for diffusing the mercury in the fluorescent lamp M12 substantially uniformly throughout the length of the glass tube M121.

As best shown in FIG. 3, this embodiment is arranged such that the base portion M131 is opposite, at the widthwise center portion thereof, to the perpendicularly diametrical portion of the glass tube M121 in order that the mercury in the glass tube M121 is diffused more uniformly. The distance H between the base portion M131 and the glass tube M121 may be within such a distance (about 10 mm or less) that the base portion M131 can function as a mercury diffuser. According to this embodiment, the distance H is set to about 10 mm.

The reflection portions M132, M133 are disposed for reflecting light coming from the both end portions of the glass tube M121 to the surface of a document, thereby to make the luminous intensity uniform. As shown in FIG. 1, the reflection portions M132, M133 are made in the form of triangles of which apexes project from the ends of the base portion M131 in the widthwise direction thereof. These reflection portions M132, M133 form so-called side reflectors which reflect light coming from each of the both end portions of the glass tube M121 to the surface of a document, thus making the luminous intensity uniform.

As shown in FIG. 3, the machine body 1 has a window 11 through which light from the fluorescent lamp M12 penetrates and reaches the document stand M4. Through the window 11, light illuminates a document d placed on the document stand M4. Light reflected from the document d, is condensed by a lens M14 attached to the unit body M11 of the optical system M1, and an image is formed by the image forming unit M2.

According to the arrangement above-mentioned, when the copying machine is turned on and the copy button (not shown) is connected to apply a predetermined voltage to the fluorescent lamp M12, light from the fluorescent lamp M12 passes through the window 11 of the machine body 1 and illuminates the document d on the document stand M4, as shown in FIG. 3. The light reflected from the document d is condensed by the lens M14. Then, predetermined image forming processings are executed. At this time, light from each of the both end portions of the fluorescent lamp M12 is reflected toward the document d by the reflection portions M132, M133 serving as the side reflectors. It is therefore possible to obtain luminous intensity uniform throughout the length of the fluorescent lamp M12.

Upon completion of the voltage application to the fluorescent lamp M12, the mercury sealed in the glass tube M121 of the fluorescent lamp M12 is solidified, as diffused uniformly throughout the length of the glass tube M121, by the base portion M131 as the mercury diffuser. Accordingly, when a voltage is applied again to the fluorescent lamp M12, ultraviolet rays are immediately radiated, enabling the fluorescent lamp M12 to be instantaneously lighted.

As thus discussed, this embodiment is arranged such that the base portion M131 serving as the mercury diffuser is stuck to the inner bottom surface of the unit body M11. This eliminates the necessity to stick an electrically conductive tape to the cylindrical glass tube M121, advantageously improving the workability and yield.

Particularly, according to this embodiment, there are formed, in an unitary structure, the base portion M131 serving as the mercury diffuser and the reflection portions M132, M133 serving as the side reflectors. Therefore, the side reflectors and the mercury diffuser can be attached simultaneously when the tape member M13 is mounted.

Accordingly, this embodiment not only reduces the number of attaching steps, but also improves the fluorescent lamp M12 in lightening performance without an electrically conductive tape stuck thereto. The elimination of the electrically conductive tape lowers the cost of the fluorescent lamp M12, resulting in a decrease in the production cost of the copying machine.

Further, the pair of reflection portions M132, M133 forming the side reflectors are integrally formed through the base portion M131 forming the mercury diffuser. This facilitates positioning the reflection portions M132, M133 when assembled with the unit body M11 of the fluorescent lamp M12. This advantageously improves the workability.

Further, according to this embodiment, the base portion M131 and the reflection portions M132, M133 are formed in a unitary structure and made of a tape member of luster aluminium. This enhances the reflectance of light from the fluorescent lamp M12.

Further, according to this embodiment, the tape member is stuck onto the flat inner bottom surface of the unit body M11. This further improves the tape adhesion workability.

Further, according to this embodiment, the base portion M131 is opposite, at the widthwise center portion thereof, to the perpendicularly diametrical portion of the glass tube M121. This further improves mercury diffusion.

In addition, according to this embodiment, the unit body M11 is formed by a resin molded article which mechanically supports the fluorescent lamp M12 and which so surrounds the fluorescent lamp M12 as to prevent the irregular reflection of light from the fluorescent lamp M12. In this connection, the unit body M11 is preferably colored in black. This further increases the difference in light and darkness between the unit body M11 and the reflection portions M132, M133. This advantageously provides more effective reflection.

Thus, according to this embodiment, the tape member M13 enables the fluorescent lamp M12 to be instantaneously lighted without an electrically conductive tape stuck thereto, and the tape member M13 itself can be readily attached.

The embodiments above-mentioned are to be considered in all respects as preferred specific examples of the present invention. For example, the electrical conductor for an optical system of the present invention may be formed by a thin plate or the like instead of the tape member, or the base portion and the reflection portions may independently be formed and made in a unitary structure. Thus, the present invention may be embodied in other specific forms without departing from the spirit or essential characteristics thereof.

The embodiments above-mentioned are therefore considered in all respects as illustrative for clarifying the technical contents of the present invention, and the present invention is not to be construed in a restricted sense as limited to these specific embodiments. Thus, the spirit and scope of the present invention are limited only by the appended claims.

What is claimed is:

1. An electrical conductor for use with an optical system including a unit body and a fluorescent lamp supported by the unit body, the lamp having a glass tube and mercury contained therein, said conductor having a length that is substantially the same as the length of the optical system lamp, and a base portion, with an upper surface and a lower surface, said upper surface including a material for causing the mercury within the fluorescent lamp tube to diffuse when said conductor is disposed in non-contacting opposition to the lamp, said lower surface being adapted for fixation to the unit body to dispose said conductor in said opposition to the lamp, wherein a pair of reflection portions are provided at both ends of said base portion for reflecting light coming from both end portions of the glass tube to a surface of a document, and wherein said base portion and said reflection portions are formed in a unitary structure and are made of a tape member of luster aluminum.

2. An electrical conductor for an optical system according to claim 1, wherein said tape member is adherable to an inner bottom surface of the unit body, the inner bottom surface being flat.

3. An electrical conductor for an optical system according to claim 1, wherein said base portion has a widthwise center portion that confronts the glass tube with respect to a diametrical direction of the glass tube along a perpendicular line.

4. An electrical conductor for an optical system according to claim 1, wherein said unit body is formed by a resin molded article which mechanically supports the fluorescent lamp and which so surrounds the fluorescent lamp as to prevent the irregular reflection of light thereon.

5. An apparatus for an optical system of an image forming machine that uses a fluorescent lamp having a glass tube of a predetermined longitudinal length, the tube containing mercury, said apparatus comprising:

unitary body means, said body means including support means for supporting the lamp of the image forming machine, and means providing a flat surface located in opposition to where the lamp is supported by said support means, said support means being arranged to support a lamp having a predetermined longitudinal length; and conductor means affixed to said flat surface to be in non-contacting opposition to the lamp supported by said support means, said conductor means having a base portion with an upper surface having a material for causing the mercury within the supported lamp to diffuse within the lamp, said conductor means having a longitudinal length that is substantially the same as the predetermined length whereby said conductor means causes diffusion of mercury within the lamp along the longitudinal length of the lamp, wherein a pair of reflection portions are provided at both ends of said base portion for reflecting light coming from both end portions of the glass tube to a surface of a document, and wherein said base portion and said reflection portions are formed in a unitary structure and are made of a tape member of luster aluminum.

6. An apparatus according to claim 5, wherein said tape member is adhered to said flat surface of said unitary body.

7. An apparatus according to claim 5, wherein said base portion has a widthwise center portion that confronts the glass tube with respect to a diametrical direction of the glass tube along a perpendicular line.

8. An apparatus according to claim 5, wherein said unitary body means is formed of a resin molded article which mechanically supports the lamp and which so surrounds the lamp as to prevent irregular reflection of light therefrom.

* * * * *